US010575708B2

(12) United States Patent
Thiyagarajan

(10) Patent No.: US 10,575,708 B2
(45) Date of Patent: Mar. 3, 2020

(54) HEATING ASSEMBLY FOR A WASHING APPLIANCE

(71) Applicant: Haier US Appliance Solutions, Inc., Wilmington, DE (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 74 days.

(21) Appl. No.: 15/671,224

(22) Filed: Aug. 8, 2017

(65) Prior Publication Data

US 2019/0046004 A1 Feb. 14, 2019

(51) Int. Cl.

| | |
|---|---|
| ***A47L 15/48*** | (2006.01) |
| ***F26B 23/00*** | (2006.01) |
| ***A47L 15/42*** | (2006.01) |
| ***A47L 15/50*** | (2006.01) |
| ***A47L 15/23*** | (2006.01) |
| ***A47L 15/00*** | (2006.01) |
| ***A47L 15/46*** | (2006.01) |

(52) U.S. Cl.

CPC ..... *A47L 15/488* (2013.01); *A47L 15/0013* (2013.01); *A47L 15/23* (2013.01); *A47L 15/4221* (2013.01); *A47L 15/4225* (2013.01); *A47L 15/4293* (2013.01); *A47L 15/46* (2013.01); *A47L 15/483* (2013.01); *A47L 15/502* (2013.01); *A47L 15/507* (2013.01)

(58) Field of Classification Search

CPC ..... A47L 15/48; A47L 15/483; A47L 15/485; A47L 15/486; A47L 15/488; D06F 58/10; D06F 58/20; D06F 58/206; D06F 58/26; D06F 18/00; D06F 25/00; D06F 29/005; F26B 23/002; F26B 23/10

See application file for complete search history.

(56) References Cited

U.S. PATENT DOCUMENTS

| | | | | |
|---|---|---|---|---|
| 8,603,260 | B2 | 12/2013 | Classen et al. | |
| 2006/0254623 | A1 | 11/2006 | Classen et al. | |
| 2009/0158928 | A1 | 6/2009 | Wu et al. | |
| 2012/0036902 | A1* | 2/2012 | Hong | D06F 29/00 68/5 C |
| 2013/0333238 | A1* | 12/2013 | Thiyagarajan | A47L 15/48 34/476 |
| 2016/0022115 | A1* | 1/2016 | Vallejo Noriega | A47L 15/486 34/572 |

FOREIGN PATENT DOCUMENTS

| | | |
|---|---|---|
| CN | 105147219 A | 12/2015 |

* cited by examiner

*Primary Examiner* — David G Cormier
(74) *Attorney, Agent, or Firm* — Dority & Manning, P.A.

(57) ABSTRACT

An open loop drying system includes an intake conduit and an exhaust conduit. The intake conduit and the exhaust conduit are each in fluid communication with an ambient environment. The open loop drying system also includes a heat pipe heat exchanger. The heat pipe heat exchanger includes a condenser section in operative communication with the intake conduit upstream of a wet chamber and an evaporator section in operative communication with the exhaust conduit downstream of the wet chamber. The open loop drying system may be provided in a dishwashing appliance.

10 Claims, 4 Drawing Sheets

HEATING ASSEMBLY FOR A WASHING APPLIANCE

FIELD

The present subject matter relates generally to washing appliances, such as dishwashing appliances and, more particularly, to a heating assembly of a washing appliance.

BACKGROUND

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles.

Fluids used in the cleaning process may be heated. For example, hot water may be supplied to the dishwasher and/or the dishwasher may include one or more heat sources for heating fluids used in wash or rinse cycle and for providing heat during a drying cycle. It is common to provide dishwashers with rod-type, resistive heating elements in order to supply heat within the wash chamber during one or more of the dishwasher cycles (e.g. during the drying cycle). Generally, these heating elements include an electric resistance-type wire that is encased in a ceramic-filled, metallic sheath. The usage of such electric heaters typically leads to increased energy consumption. Also, managing temperature throughout the wash chamber can be difficult, e.g., if any heat leaks from the wash chamber exist, such as may be due to insufficient sealing or insulation.

The wire/sheath assembly is then mounted at the bottom of the wash chamber at a location spaced apart from the bottom wall of the dishwasher tub. As a result, conventional heating elements typically take up valuable space within the wash chamber. Moreover, such heating elements are typically not very aesthetically pleasing.

Accordingly, an improved heating device for a dishwashing appliance that frees up space within the wash chamber and/or that provides for a more aesthetically pleasing look would be welcomed in the technology.

BRIEF DESCRIPTION

Aspects and advantages of the technology will be set forth in part in the following description, or may be obvious from the description, or may be learned through practice of the technology.

In one embodiment a dishwashing appliance is provided. The dishwashing appliance includes a tub defining a wash chamber, at least one spray-arm assembly positioned within the wash chamber, a fluid circulation system configured to deliver fluid to the at least one spray-arm assembly, and an open loop drying system in fluid communication with the wash chamber. The open loop drying system is also in fluid communication with an ambient environment around the dishwasher appliance. The open loop drying system includes an intake conduit and an exhaust conduit. The intake conduit extends between an inlet proximate to the ambient environment and a first outlet proximate to the wash chamber. The exhaust conduit extends between an inlet proximate to the wash chamber and an outlet proximate to the ambient environment. The open loop drying system also includes a heat pipe heat exchanger. The heat pipe heat exchanger includes a condenser section and an evaporator section. The condenser section is in operative communication with the intake conduit upstream of the wash chamber. The evaporator section is in operative communication with the exhaust conduit downstream of the wash chamber. A mixing chamber is positioned in the exhaust conduit downstream of the evaporator section of the heat pipe heat exchanger and upstream of the outlet of the exhaust conduit. A mixing conduit extends between a second outlet of the intake conduit and an inlet of the mixing chamber. The second outlet of the intake conduit is downstream of the condenser section of the heat pipe heat exchanger.

In another embodiment, a method of drying articles is provided. The method of drying articles includes flowing ambient air from an ambient environment across a condenser section of a heat pipe heat exchanger. The method also includes flowing a first portion of hot dry air from the condenser section of the heat pipe heat exchanger into a wet chamber and flowing a second portion of the hot dry air from the condenser section of the heat pipe heat exchanger into a mixing chamber. The method also includes flowing warm saturated air from the wet chamber across an evaporator section of the heat pipe heat exchanger and flowing room temperature saturated air from the evaporator section of the heat pipe heat exchanger into the mixing chamber. The method also includes mixing the room temperature saturated air from the evaporator section of the heat pipe heat exchanger with the second portion of the hot dry air from the condenser section of the heat pipe heat exchanger in the mixing chamber to create a stream of mixed air. The method further includes flowing the stream of mixed air from the mixing chamber to the ambient environment, wherein a dew point of the mixed air is less than a temperature of the ambient environment.

In yet another embodiment, an open loop drying system is provided. The open loop drying system includes an intake conduit and an exhaust conduit. The intake conduit extends between an inlet proximate to the ambient environment and a first outlet proximate to a wet chamber. The exhaust conduit extends between an inlet proximate to the wet chamber and an outlet proximate to the ambient environment. The open loop drying system also includes a heat pipe heat exchanger. The heat pipe heat exchanger includes a condenser section and an evaporator section. The condenser section is in operative communication with the intake conduit upstream of the wet chamber. The evaporator section is in operative communication with the exhaust conduit downstream of the wet chamber. A mixing chamber is positioned in the exhaust conduit downstream of the evaporator section of the heat pipe heat exchanger and upstream of the outlet of the exhaust conduit. A mixing conduit extends between a second outlet of the intake conduit and an inlet of the mixing chamber. The second outlet of the intake conduit is downstream of the condenser section of the heat pipe heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
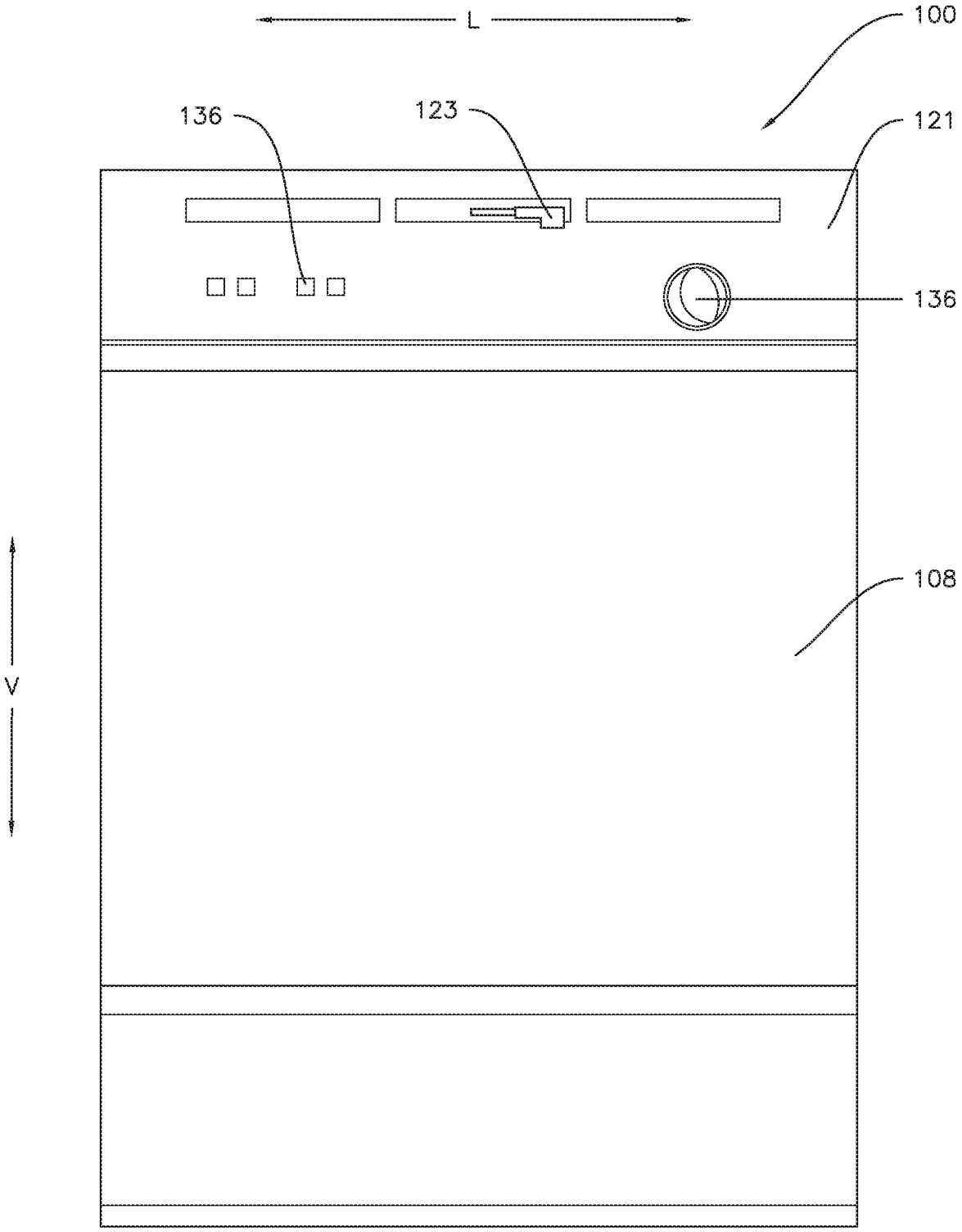
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Figure 2:
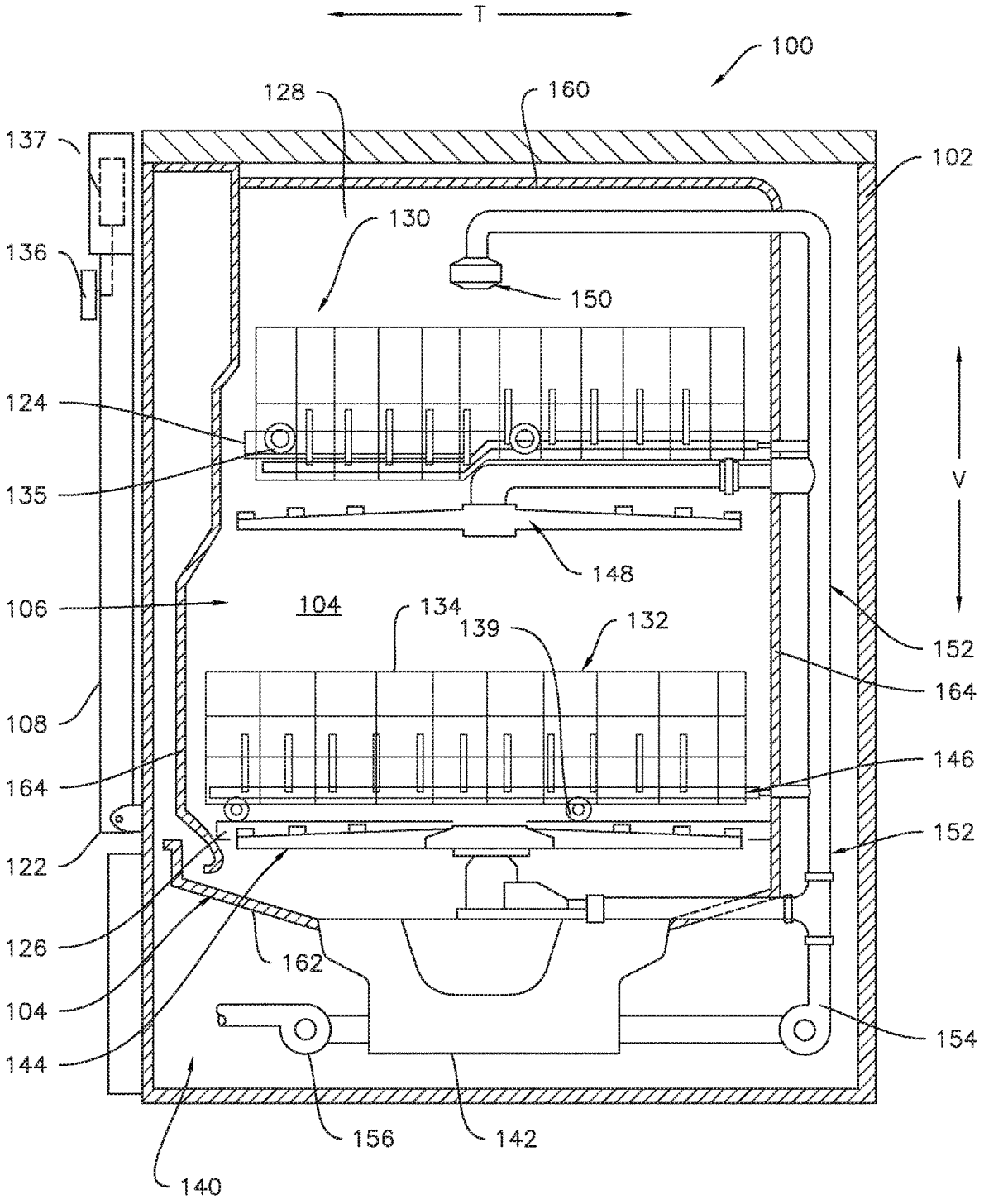
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
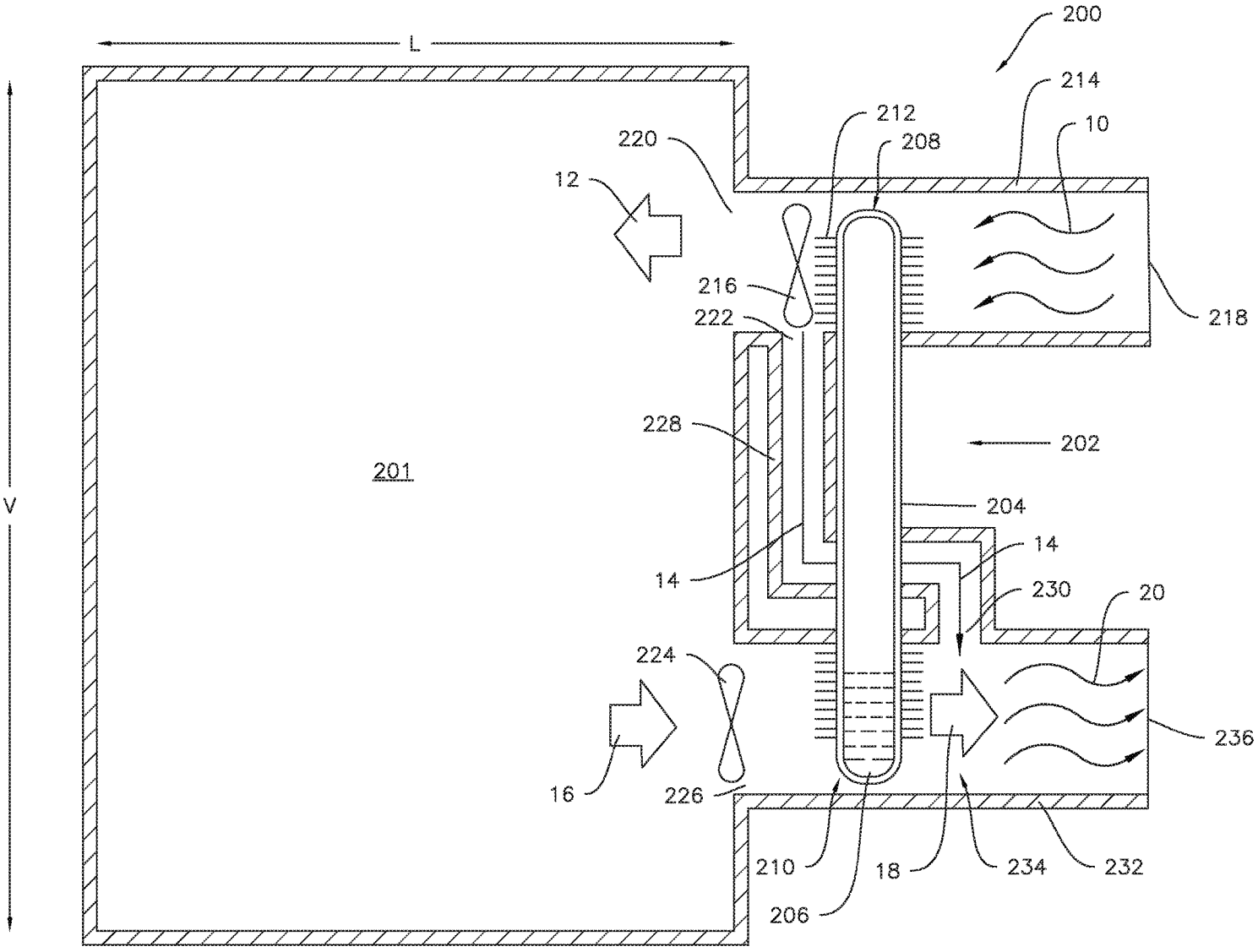
FIG. 3 provides a schematic view of an open loop drying system according to one or more embodiments of the present subject matter.

Turning now to FIG. 3, an exemplary open loop drying system 200 may be provided in fluid communication with a wet chamber 201 in order to promote drying of the chamber 201 itself and/or of wet articles therein. A heat pipe heat exchanger, hereinafter referred to as a "heat pipe," is an efficient means of transferring thermal energy, e.g., heat, from one location to another. For example, in some embodiments, as illustrated in FIG. 3, the open loop drying system 200 may include heat pipe 202, as described in more detail hereinbelow, which captures heat from outgoing humid air at one end and uses the captured heat for heating the incoming air stream on the other end. For example, in some embodiments, the wet chamber 201 may be the wash chamber 106 of dishwashing appliance 100 and wet articles, e.g., dishes, may be located therein. In such embodiments, the open loop drying system 200 may be positioned along a lateral direction L orthogonal to the transverse direction T (FIG. 2) at a side of the dishwashing appliance 100, e.g., such that the open loop drying system 200 is spaced apart from the fluid circulation system 152 (FIG. 2). In embodiments where the open loop drying system 200 is provided as part of a dishwashing appliance 100, the heat pipe 202 may advantageously be the only heat source for the drying cycle, e.g., the dishwasher appliance 100 may not include a resistance heating element and/or may not use a resistance heating element during the drying cycle. In additional embodiments, the open loop drying system 200 may be provided in other appliances or devices, such as a clothes dryer appliance, desiccator, or any other appliance or device wherein drying is desired.

The heat pipe 202 includes a sealed casing 204 containing a working fluid 206 in the casing 204. In some embodiments, the working fluid 206 may be water. In other embodiments, suitable working fluids for the heat pipe 202 include acetone, methanol, ethanol, or toluene. In other embodiments, any suitable fluid may be used for working fluid 206, e.g., that is compatible with the material of the casing 204 and is suitable for the desired operating temperature range. The heat pipe 202 extends between a condenser section 208 and an evaporator section 210. The working fluid 206 contained within the casing 204 of the heat pipe 202 absorbs thermal energy at the evaporator section 210, whereupon the working fluid 206 travels in a gaseous state from the evaporator section 210 to the condenser section 208. The gaseous working fluid 206 condenses to a liquid state and thereby releases thermal energy at the condenser section 208. A plurality of fins 212 may be provided on an exterior surface of the casing 204 at each of the condenser section 208 and the evaporator section 210. The fins 212 may provide an increased contact area between the heat pipe 202 and air flowing around the heat pipe 202 for improved transfer of thermal energy.

The heat pipe 202 may include an internal wick structure (not shown) to transport liquid working fluid 206 from the condenser section 208 to the evaporator section 210 by capillary flow. In some embodiments, the heat pipe 202 may be constructed and arranged such that the liquid working fluid 206 returns to the evaporator section 210 solely by gravity flow. For example, the dishwasher appliance 100 may be constructed such that the heat pipe 202 may be arranged along the vertical direction V with the condenser section 208 positioned above the evaporator section 210 such that condensed working fluid 206 in a liquid state may flow from the condenser section 208 to the evaporator section 210 by gravity. In such embodiments, where the liquid working fluid 206 may return to the evaporator section 210 by gravity, the wick structure may be omitted.

The open loop drying system 200 comprises an "open loop" system in that the open loop drying system 200 is in fluid communication with an ambient environment externally around the open loop drying system 200, e.g., in embodiments wherein the dishwasher appliance 100 is provided with open loop drying system 200, the ambient environment around, e.g., in close proximity to, an exterior of the dishwashing appliance 100, such as the immediate surroundings of the dishwashing appliance 100 from which air may be drawn directly into the intake conduit 214. The open loop drying system 200 is also in fluid communication with a wet chamber 201, e.g., wash chamber 106 of dishwashing appliance 100, and thus provides fluid communication between the chamber 201/106 and the ambient environment. In some embodiments, the condenser section 208 of the heat pipe 202 may be in operative communication with an intake conduit 214, e.g., as illustrated in FIG. 3, the condenser section 208 may be positioned in the intake conduit 214. As illustrated for example in FIG. 3, the intake conduit 214 may extend between an inlet 218 proximate to and in direct fluid communication with the ambient environment and a first outlet 220 proximate to and in direct fluid communication with the wet chamber 201, e.g., wash chamber 106. In such embodiments, where the inlet 218 is in fluid communication with the ambient atmosphere, ambient air 10 may pass through inlet 218, e.g., the ambient air 10 may be urged from the ambient environment through the intake conduit 214 by an intake fan 216, such that the ambient air 10 passes over and around the condenser section 208 to provide a first flow of hot dry air 12 to the wet chamber 201. As used herein, "hot air" includes air having a temperature of at least about 90° F., such as at least about 150° F., such as between about 200° F. and about 250° F., such as between about 215° F. and about 235° F., such as about 225° F. As used herein, terms of approximation, such as "generally," or "about" include values within ten percent greater or less than the stated value. For example, "about 225° F." includes from 202.5° F. to 247.5° F. As used herein, "dry air" includes air having a relative humidity less than about twenty percent, such as less than about fifteen percent, such as less than about ten percent, such as less than about five percent, such as about zero.

In addition to the first flow of hot dry air 12 supplied to the wet chamber 201, a second flow of hot dry air 14 may be routed to a mixing chamber 234, e.g., via a mixing conduit 228. As illustrated in FIG. 3, the mixing conduit 228 may extend between a second outlet 222 of the intake conduit 214 and an inlet 230 of the mixing chamber 234. The second outlet 222 of the intake conduit 214 may be downstream of the condenser section 208 of the heat pipe 202. The first flow of hot dry air 12 may travel through the wet chamber 201, e.g., in embodiments where the wet chamber 201 is wash chamber 106, to promote drying of dishes or other articles located in rack assemblies 130 and 132 within the wash chamber 106, whereupon the hot dry air 12 imparts thermal energy to and receives moisture from the articles and/or the wash chamber 106. Accordingly, an exhaust flow 16 from the wet chamber 201, e.g., wash chamber 106 of the dishwashing appliance 100, includes warm saturated air 16. As used herein, "warm air" includes air having a temperature of between about 90° F. and about 140° F., such as between about 100° F. and about 130° F., such as between about 110° F. and about 120° F. As used herein, "saturated air" includes air having a relative humidity greater than about eighty percent, such as greater than about ninety percent, such as about one hundred percent.

The open loop drying system 200 may further include an exhaust conduit 232. The exhaust conduit 232 may extend between an inlet 226 proximate to and in direct fluid communication with the wet chamber 201, e.g., wash chamber 106, and an outlet 236 proximate to and in direct fluid communication with the ambient environment. As illustrated in FIG. 3, in some embodiments, the warm saturated air 16 may enter exhaust conduit 232 through an inlet 226, e.g., the warm saturated air 16 may be urged from the wet chamber 201, e.g., wash chamber 106, through the exhaust conduit 232 by an exhaust fan 224, such that the warm saturated air 16 passes through the exhaust conduit and, in so doing, passes over and around the evaporator section 210. The evaporator section 210 may be in operative communication with the exhaust conduit 232, and in some embodiments, the evaporator section 210 may be positioned in the exhaust conduit 232 downstream of the wet chamber 201, e.g., wash chamber 106, and upstream of mixing chamber 234. The mixing chamber 234 may be positioned in the exhaust conduit 234 downstream of the evaporator section 210 of the heat pipe 202 and upstream of the outlet 236 of the exhaust conduit 232. As the warm saturated air 16 flows around the evaporator section 210, heat from the warm saturated air 16 may be transferred through the heat pipe 202 to the condenser section 208 for heating the incoming stream of ambient air 10. Accordingly, the temperature of the air may be reduced such that room temperature saturated air 18 flows from the evaporator section 210 to the mixing chamber 234. As used herein, "room temperature" includes temperatures between about 65° F. and about 75° F., such as about 70° F., such as about 72° F. In the mixing chamber 234, the room temperature saturated air 18 from the evaporator section 210 mixes with the second flow of hot dry air 14 from the mixing conduit 228, providing an exhaust flow of mixed air 20 at the outlet 236 of the exhaust conduit 232. A dew point of the mixed air 20 may be less than a temperature of the ambient environment. One of ordinary skill in the art will understand that the ambient environment includes room temperature air, e.g., the temperature of the ambient environment generally will not exceed about 75° F., as noted above.

Figure 4:
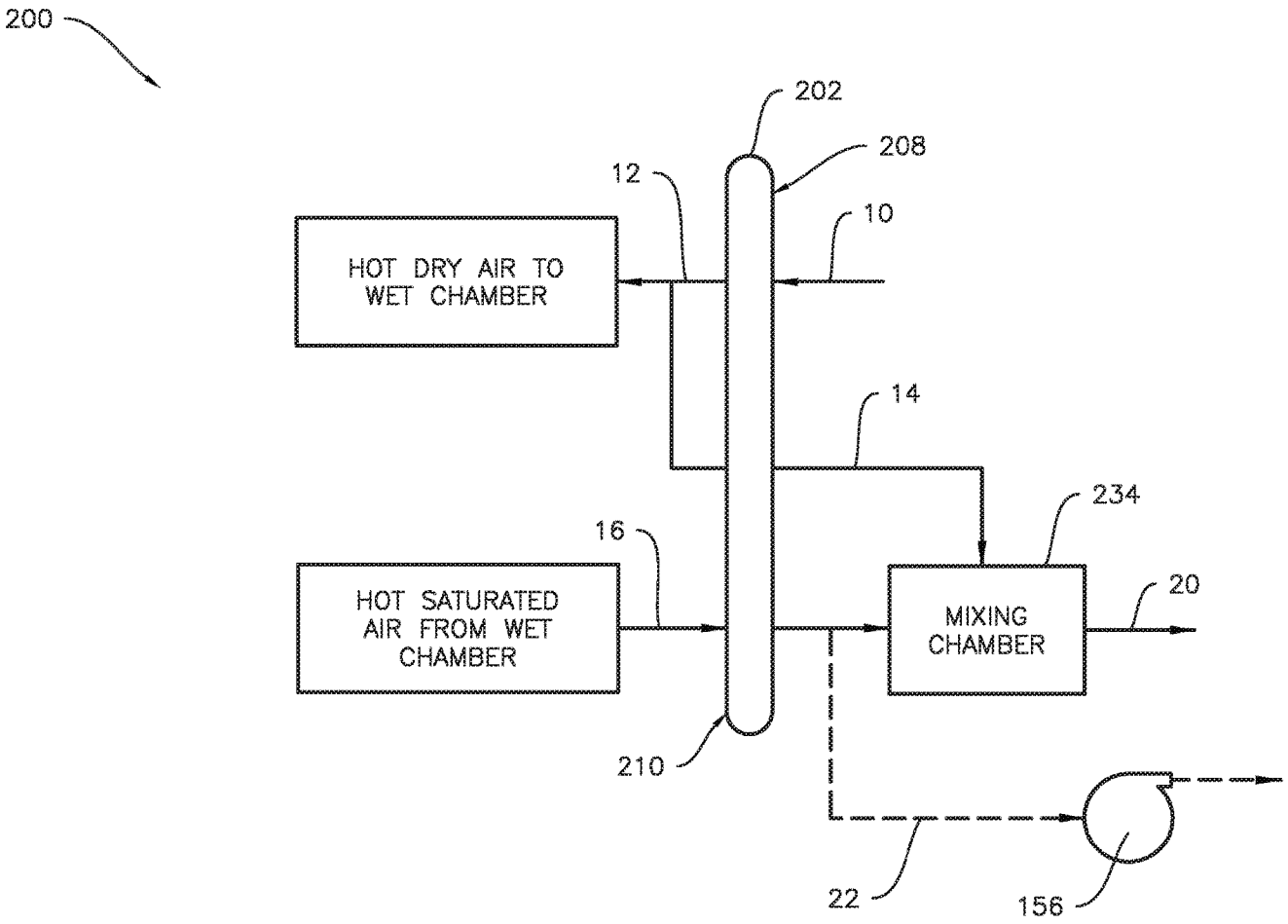
FIG. 4 provides a flow schematic of an open loop drying system according to one or more embodiments of the present subject matter.

Condensation generated in or around the mixing chamber 234 may be discharged by a drain pump 156 (FIGS. 2 and 4). For example, in embodiments where the open loop drying system 200 is provided in dishwashing appliance 100, the sump 142 may be positioned at a bottom of the wash chamber 106 for receiving fluid from the wash chamber 106 and the mixing chamber 234 may be configured to drain condensed water 22 (FIG. 4) from the mixing chamber 234 to the sump 142, whereupon the condensed water may be discharged by drain pump 156.

Another exemplary embodiment includes a method of drying articles. The method includes flowing ambient air 10 from an ambient environment across a condenser section 208 of a heat pipe heat exchanger 202. For example, flowing ambient air 10 may include operating an intake fan 216 to urge the ambient air 10 from the ambient environment across the condenser section 208 of the heat pipe heat exchanger 202. The method also includes flowing a first portion of hot dry air 12 from the condenser section 208 of the heat pipe heat exchanger 202 into a wet chamber 201, e.g., wash chamber 106 of dishwasher appliance 100, and flowing a second flow of hot dry air 14 from the condenser section 208 of the heat pipe heat exchanger 202 into a mixing chamber 234. The method also includes flowing warm saturated air 16 from the wet chamber 201 across an evaporator section 210 of the heat pipe heat exchanger 202. For example, flowing warm saturated air 16 from the wet chamber 201 may include operating an exhaust fan 224 to urge the warm saturated air 16 from the wet chamber 201 across the evaporator section 210 of the heat pipe heat exchanger 202. In some embodiments, operating the intake fan 216 may include operating the intake fan 216 at a first rate and operating the exhaust fan 224 may include operating the exhaust fan 224 at a second rate, and the first rate may be greater than the second rate. Accordingly, the air flow rates may be balanced, e.g., the first rate may be greater than the second rate by an amount corresponding to the flow rate of the second flow of hot dry air 14 through mixing conduit 228.

The method may also include flowing room temperature saturated air 18 from the evaporator section 210 of the heat pipe heat exchanger 202 into the mixing chamber 234. Thus, the method may include mixing the room temperature saturated air 18 from the evaporator section 210 of the heat pipe heat exchanger 202 with the second flow of hot dry air 14 from the condenser section 208 of the heat pipe heat exchanger 202 in the mixing chamber 234 to create a stream of mixed air 20. The method may further include flowing the stream of mixed air 20 from the mixing chamber 234 to the ambient environment. The mixed air 20 may advantageously have a dew point less than a temperature of the ambient environment, such as less than about 75° F.

In some embodiments, the method may further include one or more condensate collection steps. For example, the method may include collecting condensed water 22 from the evaporator section 210 of the heat pipe heat exchanger 202 and/or from the mixing chamber 234 and discharging the collected condensed water 22. In some example embodiments, the method may include collecting condensed water 22 from the evaporator section 210 of the heat pipe heat exchanger 202 and/or from the mixing chamber 234 in a sump 142 of the dishwasher appliance 100 and discharging the condensed water 22 from the sump 142. For example, discharging the condensed water 22 from the sump 142 may include operating a drain pump 156 to drain the sump 142.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

at least one spray-arm assembly positioned within the wash chamber;

a fluid circulation system configured to deliver fluid to the at least one spray-arm assembly; and an open loop drying system in fluid communication with the wash chamber and with an ambient environment around the dishwasher appliance, the open loop drying system comprising:

an intake conduit extending between an inlet proximate to the ambient environment and a first outlet proximate to the wash chamber;

an exhaust conduit extending between an inlet proximate to the wash chamber and an outlet proximate to the ambient environment;

a heat pipe heat exchanger comprising a sealed casing containing a working fluid therein, a condenser section defined by a first end of the sealed casing and an evaporator section defined by a second end of the sealed casing opposite the first end, the condenser section in the intake conduit upstream of the wash chamber such that ambient air flowing through the intake conduit passes directly over and around the condenser section, the evaporator section in the exhaust conduit downstream of the wash chamber such that warm saturated air flowing through the exhaust conduit from the wash chamber passes directly over and around the evaporator section;

a mixing chamber positioned in the exhaust conduit downstream of the evaporator section of the heat pipe heat exchanger and upstream of the outlet of the exhaust conduit; and a mixing conduit extending between a second outlet of the intake conduit and an inlet of the mixing chamber, the second outlet of the intake conduit downstream of the condenser section of the heat pipe heat exchanger;

wherein the open loop drying system does not include a resistance heating element.

2. The dishwashing appliance of claim 1, further comprising a sump positioned at a bottom of the wash chamber for receiving fluid from the wash chamber and wherein the evaporator section of the heat pipe heat exchanger is configured to drain condensed water from the evaporator section of the heat pipe heat exchanger to the sump.

3. The dishwashing appliance of claim 1, further comprising an intake fan configured to urge air from the ambient environment through the intake conduit.

4. The dishwashing appliance of claim 1, further comprising an exhaust fan configured to urge air from the wash chamber through the exhaust conduit.

5. The dishwashing appliance of claim 1, wherein the dishwashing appliance defines a vertical direction, the condenser section of the heat pipe heat exchanger positioned above the evaporator section of the heat pipe heat exchanger along the vertical direction such that condensed working fluid flows from the condenser section to the evaporator section by gravity.

6. An open loop drying system comprising:

an intake conduit extending between an inlet proximate to an ambient environment and a first outlet proximate to a wet chamber;

an exhaust conduit extending between an inlet proximate to the wet chamber and an outlet proximate to the ambient environment;

a heat pipe heat exchanger comprising a sealed casing containing a working fluid therein, a condenser section defined by a first end of the sealed casing and an evaporator section defined by a second end of the sealed casing opposite the first end, the condenser section in the intake conduit upstream of the wet chamber such that ambient air flowing through the intake conduit passes directly over and around the condenser section, the evaporator section in the exhaust conduit downstream of the wet chamber such that warm saturated air flowing through the exhaust conduit from the wet chamber passes directly over and around the evaporator section;

a mixing chamber positioned in the exhaust conduit downstream of the evaporator section of the heat pipe heat exchanger and upstream of the outlet of the exhaust conduit; and a mixing conduit extending between a second outlet of the intake conduit and an inlet of the mixing chamber, the second outlet of the intake conduit downstream of the condenser section of the heat pipe heat exchanger;

wherein the open loop drying system does not include a resistance heating element.

7. The open loop drying system of claim 6, wherein the evaporator section of the heat pipe heat exchanger is configured to drain condensed water from the evaporator section of the heat pipe heat exchanger to a sump.

8. The open loop drying system of claim 6, further comprising an intake fan configured to urge air from the ambient environment through the intake conduit.

9. The open loop drying system of claim 6, further comprising an exhaust fan configured to urge air from the wet chamber through the exhaust conduit.

10. The open loop drying system of claim 6, wherein the condenser section of the heat pipe heat exchanger positioned above the evaporator section of the heat pipe heat exchanger along a vertical direction such that condensed working fluid flows from the condenser section to the evaporator section by gravity.

* * * * *